United States Patent [19]

Yoshimori

[11] 4,149,104

[45] Apr. 10, 1979

[54] METHOD OF MANUFACTURING A COIL HEATER OF AN INDIRECTLY-HEATED TYPE CATHODE ELECTRODE OF ELECTRONIC TUBES

[75] Inventor: Norihisa Yoshimori, Mobara, Japan

[73] Assignee: Hitachi, Ltd., Tokyo, Japan

[21] Appl. No.: 860,853

[22] Filed: Dec. 15, 1977

[30] Foreign Application Priority Data

Dec. 15, 1976 [JP] Japan ..... 51/167255[U]

[51] Int. Cl.[2] ..... H05B 1/00

[52] U.S. Cl. ..... 313/340; 29/611; 29/618; 140/71.5; 242/7.15; 338/296

[58] Field of Search ..... 29/611, 618; 140/71.5; 338/296, 298; 242/7.15, 7.16; 219/335; 313/270, 271, 340, 344

[56] References Cited

U.S. PATENT DOCUMENTS

| | | | |
|---|---|---|---|
| 1,972,162 | 9/1934 | Parrott | 29/618 |
| 2,287,460 | 6/1942 | Wagenhals | 29/618 |
| 3,124,169 | 3/1964 | Schade | 140/71.5 |
| 3,303,859 | 2/1967 | Ackermann | 140/71.5 |
| 3,869,692 | 3/1975 | Larson | 313/340 |
| 3,943,328 | 3/1976 | Cunningham | 29/611 |

*Primary Examiner*—C. W. Lanham
*Assistant Examiner*—Gene P. Crosby
*Attorney, Agent, or Firm*—Charles E. Pfund

[57] ABSTRACT

A coil heater of a heater-type tube comprises a main portion for generating heat and a pair of leg portions supporting the main portion. Lead wires are connected to the ends of the legs. At least a part of the leg portion, including its terminal part, comprises a triple-layer coil. The main portion comprising a single-layer coil and the leg portion except its terminal part covered with an insulating coating. The main portion and leg portions are formed by continuously winding a heater wire about a core alternately in opposite directions.

5 Claims, 10 Drawing Figures

METHOD OF MANUFACTURING A COIL HEATER OF AN INDIRECTLY-HEATED TYPE CATHODE ELECTRODE OF ELECTRONIC TUBES

BACKGROUND OF THE INVENTION

This invention relates to a method of manufacturing a heater of an indirectly-heated type cathode structure of an electronic tube, and a heater manufactured by said method.

In a conventional heater of an indirectly-heated type cathode structure, the heater comprises a main portion formed by helically winding a heater wire and then shaping into a desired configuration, leg portions connected to the opposite ends of the main portion and an electric insulator such as alumina coating the main portion and a part of the leg portions so that the heater has a large thermal capacity throughout these portions. Thus, the free, terminal or end parts of the legs are bare and connected to bare lead wires for connection with a heater source. Since the thermal capacity of bare leg terminal parts are smaller than that of the portions covered with the electric insulator, the bare terminal parts of legs are rapidly heated immediately after starting and before an electronic tube incorporated with the indirectly-heated type cathode electrode reaches normal operating condition, resulting in frequent breaking of the heater wire. Moreover, since the portions covered with the insulator and having a relatively large weight are supported by the bare leg terminal parts, where the length of the heater is long and where the heating wire is thin, when subjected to external shocks and vibrations, not only the heating wire breaks but also a portion of the insulator scatters, turning into foreign material to the tube, thereby causing failure of the tube.

To solve this problem, it has been proposed to weld lead wires to a coil heater and then to coat the bare ends of the legs with such insulator as alumina. This method, however, cannot positively prevent peeling off of the insulator because the insulator coated after welding lead wires cannot be sintered at a high temperature and hence bonding of alumina is poor.

According to another solution, a mandrel made of metal having high melting temperature and an inner diameter substantially equal to the diameter of the coil is fitted into the leg ends until the top of the mandrel adjoins the insulator coating. Application of the mandrel to a coil heater made of a fine heating wire requires careful hand working.

According to still another method, cylindrical metal sheaths are fitted over the ends of the bare legs. Although this method is advantageous where the legs are straight, in case where the heater is formed by helically winding a thin heating wire, it often happens that the coiled leg ends are crushed when applying the sheath thereover, causing the heating wire to be broken. This method also requires hand working.

SUMMARY OF THE INVENTION

It is an object of this invention to provide an improved heater of an indirectly-heated type cathode structure of an electronic tube capable of eliminating the disadvantages described above by increasing the thermal capacity and mechanical strength of the terminal parts of the legs of a coil heater.

According to this invention, there is provided a method of manufacturing a coil heater of an indirectly-heated type cathode electrode of an electronic tube of the type wherein the coil heater comprises a main portion and leg portions connected to the main portion and is adapted to be contained in a cathode sleeve, said method comprising the steps of winding a length of heater wire about a core in a given direction over a first distance to form a single-layer first coil; winding the heater wire about the first coil in the opposite direction over a second distance to form a double-layer second coil; winding the heater wire about the second coil and then about the core over a third distance in the given direction to form a triple-layer third coil and an additional single layer coil; winding the heater wire about the additional single-layer coil over a fourth distance and in the opposite direction to form an additional double-layer coil; winding the heater wire about the additional double-layer coil over the fourth distance in the given direction to form an additional triple-layer coil; continuously baking the resulting coils; severing the coils at the centers of the triple-layer coils; shaping the additional single-layer coil into the main portion; applying an insulating coating onto the main portion and a part contiguous thereto of the triple-layer third and additional triple-layer coils; firing the insulating coating; and removing the core from the coils.

DESCRIPTION OF THE PREFERRED EMBODIMENTS

Figure 1:
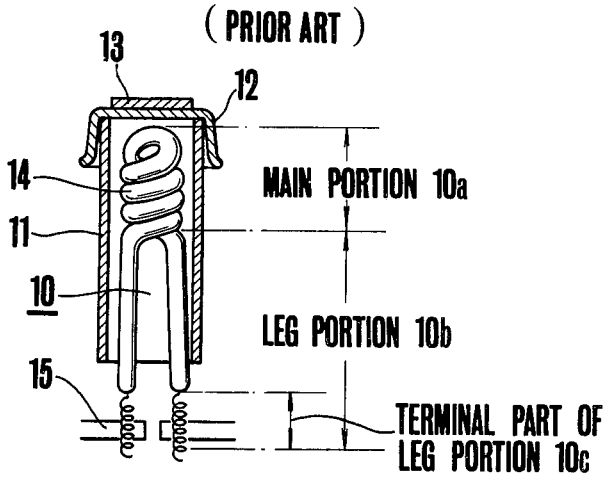
FIG.1 (PRIOR ART)
FIG. 1 is a side view, partly in section, showing a typical prior art heater of an indirectly-heated cathode structure for use in electronic tubes.

As shown in FIG. 1, a prior art heater of an indirectly-heated cathode structure of an electronic tube comprises a coil heater 10 contained in a cathode sleeve 11, a cap 12 closing the upper end of the cathode sleeve 11 and an electron emitting substance 13 mounted on the cap 12. The coil heater 10 comprises a main portion 10*a* and a pair of leg portions 10*b* for supporting the same. Exept the end or terminal parts 10*c* of the leg portion, the main portion 10*a* and the legs 10*b* are covered with insulator 14, for example alumina, and the bare end parts 10*c* of the legs are welded to lead wires 15 which are connected to a heater source, not shown. The cathode sleeve 11 has a length sufficient to surround the main portion 10*a* and the substantial length of the leg portions 10*b*.

In the example shown in FIG. 1, a length of heating wire is wound into a coil, and the main portion is further coiled, thus forming a double helical heater.

Figure 2:
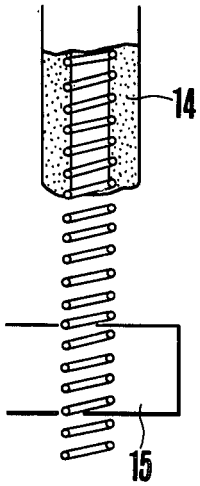
FIG.2 (PRIOR ART)
FIG. 2 is an enlarged longitudinal sectional view showing the terminal part of one leg of the coil heater shown in FIG. 1.

As best shown in FIG. 2, since the end parts 10*c* of the legs secured to lead wires 15 are bare, the thermal capacity of these parts is smaller than that of the remaining parts of the legs and the main portion which are covered with insulator, at the time or engergization of the coil heater, these bare terminal parts would be overheated, thereby causing breakage. Moreover, these bare leg ends do not have a mechanical strength sufficient to support the weight of the remaining parts of the legs and the main portion.

Figure 3:
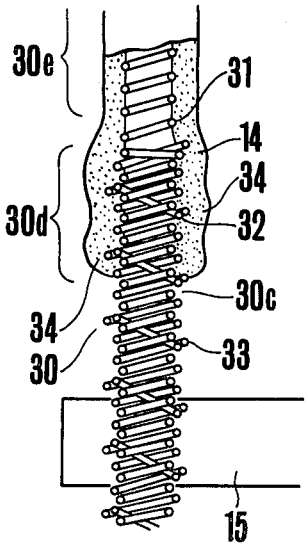
FIG. 3 is an enlarged longitudinal sectional view showing the terminal part of one leg of the coil heater embodying the invention.

In a preferred embodiment of this invention illustrated in FIG. 3, since the construction of the cathode sleeve, the cap, etc. is the same as that shown in FIG. 1, they are omitted, and only the terminal of one leg is shown with a magnified scale.

According to this invention a single-layer coil 31, which is later shaped into the main portion and the remaining part of the leg, is wound about the end part 30*c* of the leg, a double-layer coil 32 is wound about the extension of the single-layer coil and a triple-layer coil 33 is wound about the double-layer coil. Thus, after forming the single-layer coil, the double-layer coil is wound in the opposite direction and then the triple-layer coil is wound in the opposite direction and then the triple-layer coil is wound in the same direction as the single-layer coil, and the pitch of the double-layer coil is more than twice that of the single-layer coil. With this construction, the turns of the double-layer coil 32 would not enter between the turns of the single-layer coil 31 thereby facilitating manufacture of a double-layer coil. Moreover, as the double-layer coil binds the single-layer coil, it is possible to increase the mechanical strength of the end part of the leg. The upper limit of the ratio of the pitches of the single- and double-layer coils is about 10. If the ratio is larger than this limit, when winding the double-layer coil in the opposite direction the folding back point between the single- and double-layer coils varies, thus varying the length of the triple-layer coil. This, in turn, causes variation in the length of the main portion.

In this example, the triple-layer coil 33 has the same pitch as the single-layer coil 31. The alumina coating 14 covers the main portion of the heater as well as a part of the leg portion having triple-layer coil construction. Accordingly, the bare end part 30*c* of the leg which is connected to the lead wire 15 is formed as a triple-layer coil, and the remaining part 30*d* of the leg is also formed as a triple-layer coil and covered with the insulator. If the insulator is applied not extending to the portion 30*d* but disappearing at the end of the single-layer coil as designated by 31, this end would be exposed. Such an exposed portion would be overheated at the start of heating. The insulator covering the triple-layer coil has ribs 34 on its periphery which have larger diameter than that of the insulator covering the main portion comprising the single-layer coil. For this reason, the ribbed insulator comes in point contact with the inner surface of the cathode sleeve thereby improving electric insulation than plane contact at portion 30*e* not including ribs.

Figure 4:
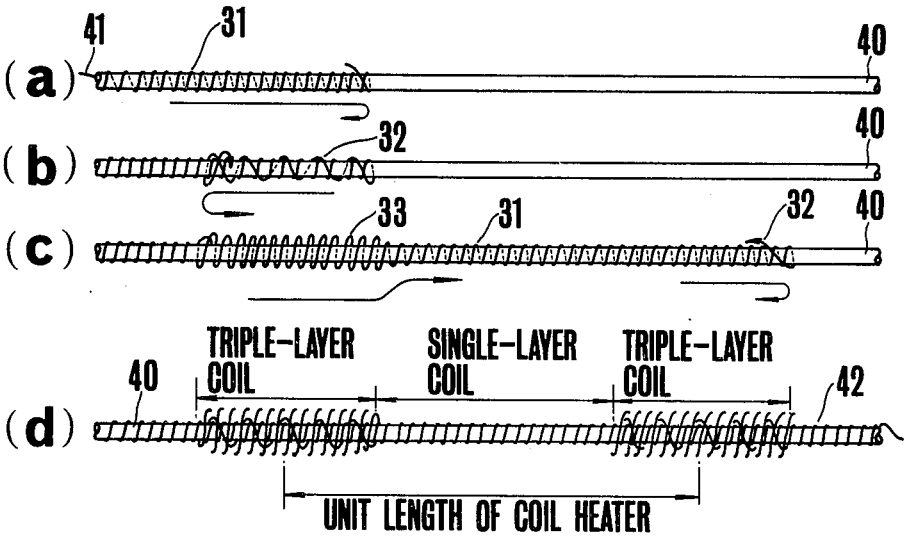
FIGS. 4*a* through 4*d* are diagrammatic representations showing the method of manufacturing the coil heater of this invention.

According to this invention, the coil heater is manufactured in the following manner. Thus, as shown in FIG. 4*a* at first a heater wire 41 made of tungsten is wound about a core 40 made of molybdenum or the like, to form a first coil 31. Then the heating wire is wound about the first coil in the opposite direction to form a second coil 32 as shown in FIG. 4*b*. Thereafter, the heating wire is wound about the second coil in the same direction as the first coil to form a third coil 33 as shown in FIG. 4*c*. As above described the pitch of the first and third coils is from twice to ten times the pitch of the second coil and these three coils overlap one upon the other. Arrows show the direction of windings.

The heating coil 42 thus formed is continuously baked in a hydrogen furnace heated at a temperature of 1300° to 1500° C. to eliminate the tendency of spring back of the coil. The coil and core are severed into a length of one coil heater at the centers of the triple-layer coils. Then the cut length is shaped into a double helical shape or a hook shape to obtain a main portion. Then an alumina insulator 14 is applied and fired. Thereafter the core 40 is dissolved off thus completing the coil heater. As described above, the insulator 14 is applied to also cover a part of the triple-layer coil of the leg portion.

The first coil 31 and the third coil 33 may have different pitches depending upon the strength required for the leg. However, the same pitch is preferred because it simplifies the winding pattern and increases the efficiency of winding.

Figure 5:
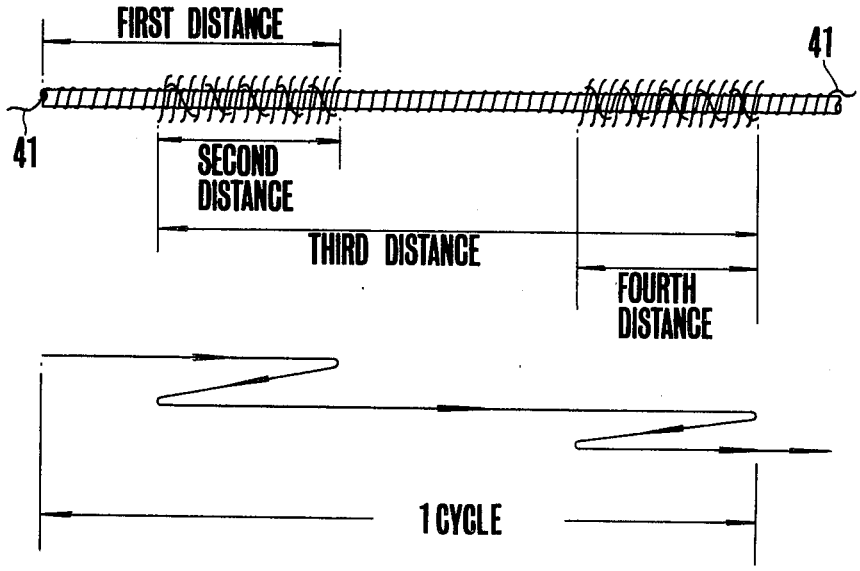
FIG. 5 is a side view showing the steps of manufacturing the coil heater shown in FIG. 4.

FIG. 5 is a diagram showing more clearly various steps of this invention for manufacturing a triple-layer coil. Arrow at the bottom of FIG. 5 show the directions of winding the first, second and third coils.

A length of heater wire is wound about the core over a first distance. Then the heater wire is wound in the opposite direction over a second distance which is shorter than the first distance. Then the direction of winding is reversed for winding the heater wire over a third distance longer than the second distance. At the end of the third distance, the direction of winding is reversed and the heater wire is wound about the cover over a fourth distance. The direction of winding is further reversed for winding the heater wire over the fourth distance, completing one cycle of winding. The above described cycle of winding steps is repeated.

It is advantageous to make equal the pitches of the first and third coils and to make these pitches to be 2 to 3 times those of the second coil and of the coil wound over the fourth distance. Further, it is advantageous to make equal the first and third distances and to make equal the second and fourth distances for the purpose of easily automating the winding operation.

EXAMPLE 1

Figure 6A:
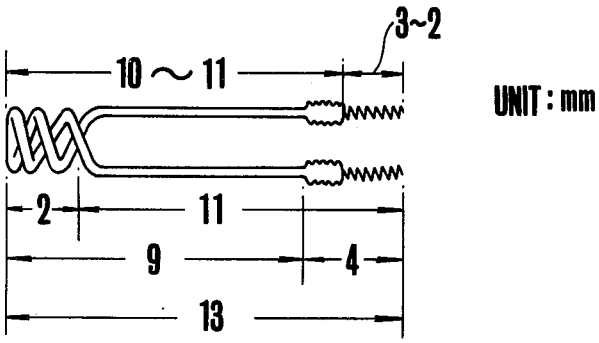
FIG. 6A is a side view showing one example of the coil heater according to this invention.

One example of manufacturing a coil heater having a rating of AC 6.3 V and 225 mA will now be described with reference to FIG. 6A. A molybenum wire having a diameter of 0.125 mm was used as the core and a tungsten heating wire having a diameter of 0.045 mm was continuously wound about the core according to the steps shown in FIG. 5. A single-layer coil having 400 turns was formed by winding the heating wire over the first distance of 38 mm at a pitch of 105 turns/cm, and then the wire was folded back and wound in the opposite direction over the second distance of 8 mm at a pitch of 35 turns/cm to form a double-layer coil having 8 turns. Thereafter, the heating wire was wound in the same direction as the single-layer coil over the third distance of 38 mm at a pitch of 105 turns/cm to form an additional single-layer coil having 400 turns, thus completing the main portion. In this example, the length of the first and third distances and the pitches over these distances were respectively made equal for the purpose of facilitating automation. Then the direction of winding was reversed and the heating wire was wound over the fourth distance of 8 mm at a pitch of 35 turns/cm to form an additional double-layer coil having 8 turns. In this manner, coils having a dense pitch of 105 turns/cm and oppositely wound coils having a coarse pitch of 35 turns/cm are formed alternately to form a continuous coil in which triple-layer coils having a length of 8 mm and a single-layer coil having a length of 22 mm are included alternately.

The coil thus formed was continuously baked in a wet hydrogen furnace maintained at a temperature of 1300° C. to eliminate the tendency of spring back. Then the coil was cut at the center of the triple-layer coils to produce coils having a unit length of 30 mm including a single layer coil having a length of 22 mm and forming the main portion and a portion of the legs, a triple-layer coil having a length of 4 mm and forming the end part of the legs. A portion of the single-layer coil is shaped by a double helical coil winder to obtain a double helical main portion as shown in FIG. 6A. In this case, a hardened steel wire having a diameter of 0.65 mm was used as a mandrel for forming the double helical main portion and the pitch thereof was made to be about 13.8 turns/inch thus forming a coil heater having a main portion of 2 mm, leg portions of 11 mm, and triple-layer coil parts acting as the bare terminal part of the leg portions and having a length of 4 mm. Thereafter, the mandrel used to form the double helical main portion was removed.

Alumina powder having a particle size of 900 mesh was coated by electrostatic coating method on the main portion and 1 to 2 mm of the triple-layer coil of the legs to a thickness of about 85 microns. The coated heater was baked in a hydrogen furnace maintained at a temperature of from 1600° to 1650° C. and the molybdenum wire core was removed by dissolving it by a mixture consisting of 50% of nitric acid, 30% of sulfuric acid and 20% of water by volume thus completing the heater. Of course, the tungsten heating wire has a sufficient resistance against the dissolving action of the mixture. In a cathode heater for use in a rapid start cathode ray tube, dark alumina consisting of a tungusten powder and an alumina powder was coated on the alumina coating and then the heater was baked to obtain a dark heater.

EXAMPLE 2

Figure 6B:
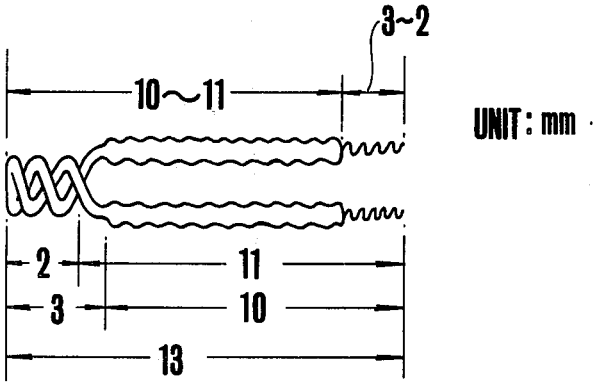
FIG. 6B is a side view showing another example of the coil heater according to this invention.

FIG. 6B shows a coil heater having a rating of Ac 6.3 V, and 125 mA which was manufactured with the following parameters:

mandrel: molybdenum wire having a diameter of 0.125 mm heater wire; tungusten wire having a diameter of 0.030 mm first distance: 49 mm, pitch-190 turns/cm second distance: 19 mm, pitch-60 turns/cm third distance: 49 mm, pitch-190 turns/cm second coil over the fourth distance: 19 mm, pitch-60 turns/cm third coil over the fourth distance: 19 mm, pitch-190 turns/cm The continuous coil thus obtained was cut at the center of the triple-layer coil portions into unit length of 30 mm. The completed heater coil has dimensions as shown in FIG. 6B. As shown in this figure, since nearly all length of the leg portions comprises triple-layer coils it is possible to decrease the electric resistance of the legs and hence the heat generated thereby is smaller than the embodiment shown in FIG. 6A.

As can be noted from the foregoing description, the heater of the indirectly-heated cathode structure of this invention has the following advantages:

1. Since, at least a part of the leg portion is reinforced by triple-layer construction, it is possible to increase the mechanical strength and the thermal capacity of the leg end not provided with the insulating coating, thereby preventing breakage of the heating wire due to overheat at the time of starting.

2. Under steady state, at the triple-layer portion, since the heater current distributes among respective coils, it is possible to decrease heat generation so as to maintain the legs at a low temperature enough to prevent electron emission. Accordingly it is possible to prevent glow discharge at these portions, and hence electric discharge between the legs and other electrodes (including the neck of the electronic tube), thus preventing damage of the heater.

3. As the second coil at the triple-layer portion has a coarse pitch, ribs corresponding to this coarse pitch are formed on the surface of the insulator coated on the triple-layer coil so that when the coil is contained in the cathode sleeve, the finished coil contacts with the sleeve only at these ribs thus preventing decrease in the insulating characteristic.

4. There is no fear of crushing the heater terminal at the time of welding heater wires to lead wires. Moreover, it is possible to prevent deformation and breakage of the heater wire due to shock and vibration.

5. It is possible to continuously wind the coil heater by merely modifying a portion of the winding steps utilized to manufacture prior art heaters. Accordingly, the invention is suitable for mass production capable of producing reliable heaters at low cost.

What is claimed is:

1. A method of manufacturing a coil heater of an indirectly-heated type cathode electrode of an electronic tube of the type wherein said coil heater comprises a main portion and leg portions connected to said main portion and is adapted to be contained in a cathode sleeve, said method comprising the steps of winding a length of heater wire about a core in a given direction over a first distance to form a single-layer first coil;

winding said heater wire about said first coil in the opposite direction over a second distance to form a double-layer second coil;

winding said heater wire about said second coil and then about said core over a third distance and in said given direction to form a triple-layer third coil and additional single layer coil;

winding said heater wire about said additional single-layer core over a fourth distance and in said opposite direction to form an additional double-layer coil;

winding said heater wire about said additional double-layer coil over said fourth distance in said given direction to form an additional triple-layer coil;

continuously baking the resulting coils;

severing said coils at the centers of said triple-layer coils;

shaping said additional single-layer coil into said main portion;

applying an insulating coating onto said main portion and a part contiguous thereto of said triple-layer third and additional triple-layer coils;

firing said insulating coating; and removing said core from said coils.

2. The method according to claim 1 wherein coils wound in said given direction over said first and third distances have the same pitch.

3. The method according to claim 1 wherein the coils wound in said reverse direction over said second and fourth distances have a pitch 2 to 3 times that of the coil wound in said given direction over said first distance.

4. The method according to claim 1 wherein said first distance is more than twice said second distance, said first and third distances are equal, and said second and fourth distances are also equal.

5. A coil heater prepared by the method as recited in claim 1 and utilized in an indirectly-heated type cathode electrode of an electronic tube.

* * * * *